United States Patent [19]

Hergeth

[11] Patent Number: 4,595,149

[45] Date of Patent: Jun. 17, 1986

[54] APPARATUS FOR REDUCING FIBER BALES BY WAY OF AN OPENING DEVICE

[76] Inventor: Hubert Hergeth, Kapellenweg 3, D-4408 Dülmen, Fed. Rep. of Germany

[21] Appl. No.: 652,776

[22] Filed: Sep. 19, 1984

[30] Foreign Application Priority Data

Sep. 22, 1983 [DE] Fed. Rep. of Germany ..... 3334222

[51] Int. Cl.[4] ..... B02C 23/26

[52] U.S. Cl. ..... 241/101 A; 19/80 R; 241/58; 241/101.7

[58] Field of Search ..... 406/70, 144, 155; 241/101 A, 101.7, 57, 58, 277, 282.1; 19/80 R, 80 A

[56] References Cited

U.S. PATENT DOCUMENTS

| | | | |
|---|---|---|---|
| 477,692 | 6/1892 | McConnell | 406/144 |
| 4,365,764 | 12/1982 | Marx | 241/101 A |
| 4,498,633 | 2/1985 | Williams | 241/57 X |

FOREIGN PATENT DOCUMENTS

| | | | |
|---|---|---|---|
| 561067 | 10/1932 | Fed. Rep. of Germany | 406/144 |

*Primary Examiner*—Mark Rosenbaum
*Attorney, Agent, or Firm*—Cort Flint

[57] ABSTRACT

In the opening device for reducing fiber bales, e.g. cotton and staple fiber bales or the like, the opening rollers are arranged in a housing. The detached fibers or flocks are carried away in direction of the longitudinal axis of the opening rollers by means of a vacuum current in the housing. At the air discharge side of the housing (7) of the opening device, an air-conducting surface (17) projecting into the housing (7) is mounted above the opening rollers (8,9) and beneath the suction piece (12).

6 Claims, 3 Drawing Figures

APPARATUS FOR REDUCING FIBER BALES BY WAY OF AN OPENING DEVICE

The invention relates to an apparatus for reducing fiber bales, e.g. cotton or staple fiber bales etc. by way of an opening device in which a milling means, e.g. a milling roller, is provided in a housing and travels to and fro along the row of bales.

There have been known automatic multi-bale openers, in particular for short staple fibers, in which the removing assembly may be reciprocated along a row of press bales. A frame or tower which is moved to and fro on rails or the like, is provided with a cantilever having a removing means in its housing. Said removing means comprises rotating opening rollers between which detached fibers are thrown upwardly to get into a channel which extends along the opening rollers to lead to the frame or tower within which the removed material is further conveyed by a suction draft.

It turned out that the transport of the detached flocks or the like from the opening means, i.e. from the gap formed by the opening rollers, in direction of the longitudinal axis of the housing or of the channel provided in said housing, by means of a vacuum current, is far from being satisfactory. This is above all so if the bales disposed in rows are not at the right distance from the tower or not in parallel to the guiding rails. In such a case, if bales are in a more or less retreated position, infiltrated air may get into the suction channel thus impairing the suction capacity of the opening device. It is not always possible to align the bales along the travel ofthe tower. Very often, the exact line-up of fiber bales causes considerable expenditure.

It is the object of the invention to ensure and basically improve the suction capacity of the opening device regardless of the accuracy by which the fiber bales are disposed in rows. With the reducing means disclosed above, the invention is characterized in that at the air discharge side of the housing or of the air channel, an air-conducting surface projecting into the housing or channel is provided above the milling device and beneath the suction piece at the front wall of the housing.

Due to the air-conducting surface extending in axle direction of the opening rollers, also at this side of the removing means, in spite of a more or less regular line-up of the fiber balls, the detached fibers or flocks may be sucked off as intensely as at the other external end of the removing means or within the reach of its ends. As a matter of fact, with an irregular set-up of the fiber bales, the air-conducting surface projects beyond the resultant free space so that the suction action will not become effective directly at the front-sided free space of fiber bales in more or less retreated position. On the contrary, by the suction current in the air duct, an injector effect is caused by the air-conducting surface by means of which fibers or flocks detached at the fiber bale front side facing the tower or the like are entrained upwardly towards the main suction current. Thus, with an improved suction capacity, it is no longer necessary to insist on a fiber bale erection along a straight line. In addition to the improved suction capacity, less time is now required to prepare the row of fiber bales.

According to another feature of the invention, it is suitable for the air-conducting surface that it is a beam-shaped three-dimensional body which—seen in cross section—has a round nose portion. Moreover, the underside of the beam-shaped threedimensional body is inclined downwardly. As a result, thereof, the injector effect is substantially supported and the air current is guided with poor friction to the air current in the suction channel.

Although the upper side of the air-conducting body may be horizontal, it may be also inclined suitably relative to the suction piece. One embodiment of the invention will be explained hereunder in more detail with reference to the enclosed drawing.

Figure 1:
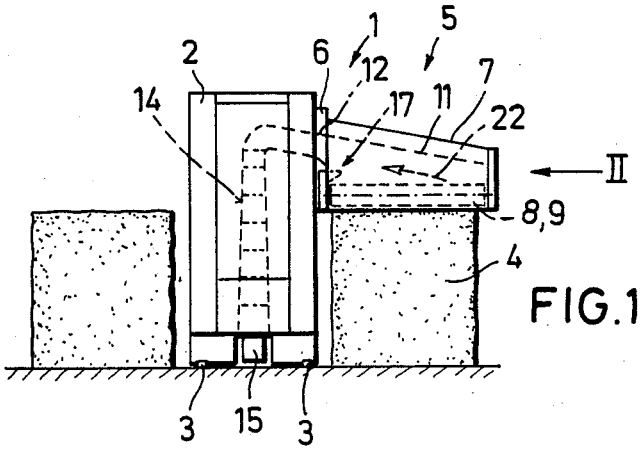
FIG. 1 is a schematic view of an apparatus for reducing bales according to the invention.
Figure 2:
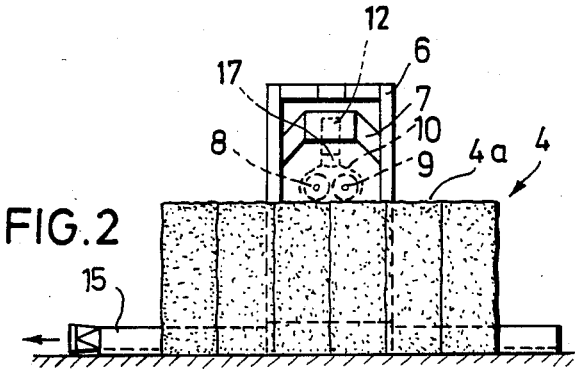
FIG. 2 is a front view of the reducing apparatus of FIG. 1 seen in direction of arrow II.
Figure 3:
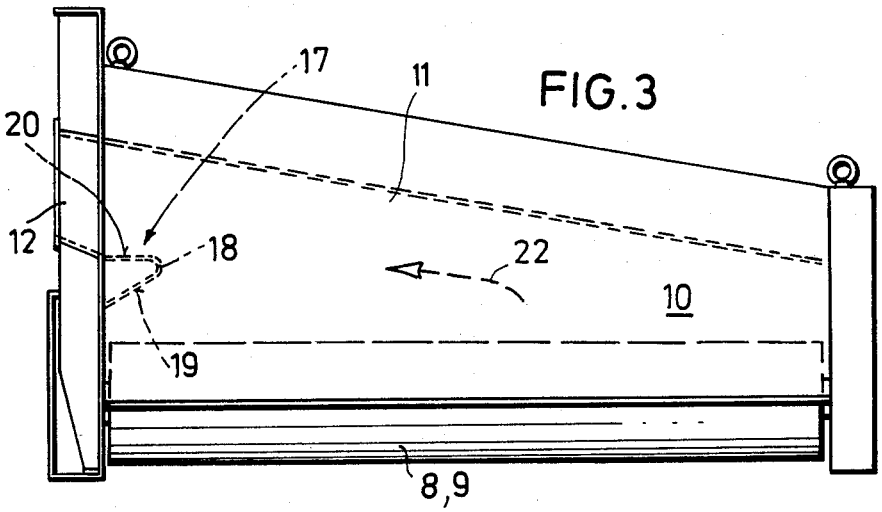
FIG. 3 is a schematic scaled up view of the cantilever secured to the tower, with reducing apparatus and air-conducting plate.

The apparatus 1 for reducing pressed fiber bales by way of an opening device contains a frame or tower 2 which may travel to and fro on rails 3 or the like along a row 4 of bales. The tower 2 is provided with a cantilever 5 which is fixed by a flange 6 at the side of the tower 2. In the housing 7 of the cantilever 5, opening rollers 8 and 9 rotating oppositely to the center of the roller pair remove from the upper surface 4*a* of the row of bales fibers or flocks which are thrown upwardly between them. The pair of rollers 8,9 is surrounded by a suction casing 10 which extends over the length of the opening rollers 8,9 to form a channel 11 ending at a suction piece 12. Within the tower 2, the conveyed suction current gets through the telescopic conduit 14 to the lower suction channel 15. With a progressive removal of the press bale height, the cantilever 5 is lowered correspondingly.

At the side of the cantilever casing 7 facing the tower 2, an air-conducting plate 17 projecting into said casing is provided above the opening rollers 8,9 and beneath the suction piece 12.

Suitably, the air-conducting surface 17 is a beam-shaped, three dimensional body having a round front portion 18 which passes over into a downwardly extending oblique underside 19. The upper side 20 of the air-conducting body 18 may have a horizontal or somewhat upwardly inclined extension adjoining the lower surface of the suction piece 12.

Due to the vacuum current 22 flowing in channel 11 towards the outlet piece 12, the air-conducting surface causes an injector effect. The infiltrated air resulting with fiber bales in retreated position due to the larger free space between the fiber bales and the tower is absorbed by the injector effect to be conducted into the suction current 22. At the same time, fibers or flocks detached at this side are fed by the injector action into the main current 22 to be carried away therewith. The air conducting nose 17 shall extend into the suction channel 11 to such an extent as admissible by the maxi deviation of a fiber bale in retreated position from the guide line. Thus, it is possible that bales need not be disposed any longer exactly in rows along a line.

What is claimed is:

1. Apparatus for opening fiber bales such as bales of cotton and staple fibers by means of an opening device which includes a housing, roller means carried in said housing for opening said fiber bales by removing fibers from said bales, said roller means having a longitudinal axis about which said roller means rotates for removing said fibers and opening said fiber bales, said housing including a channel in which a suction air current is established for carrying said removed fibers away from said roller means, said housing further including an air discharge side having a suction opening through which said suction air current and fibers are discharged from said housing for conveyance for further processing, wherein the improvement comprises:

an air conducting element carried by said housing at said air discharge side and projecting into said housing above said roller means and below said suction opening at said air discharge side of said housing;

said air conducting element carried by said housing extending into said housing in a direction opposite to that direction in which said suction air current flows in said housing in a manner that the air conducting element bridges any gap created by offset bales and effectively minimizes the effects of secondary air entering said housing; and said air conducting element having a surface which adjoins said air discharge side of said housing adjacent said suction opening.

2. The apparatus of claim 1 wherein said roller means comprises a pair of opening rollers which rotate in opposite directions.

3. The apparatus according to claim 1 wherein said air conducting element includes a beam-shaped three-dimensional air conducting body having a first side which adjoins said housing adjacent said suction opening, said first side extending away from said suction opening and terminating in a nose, said air conducting body having a second side extending downwardly from said nose obliquely toward said air discharge side of said housing.

4. The apparatus of claim 3 wherein the nose of said air conducting body comprises a round nose portion.

5. The apparatus according to claim 3 or 4 wherein said first side of said air conducting body extends horizontally into said housing.

6. The apparatus according to claim 3 or 4 wherein said first side of said air conducting body is inclined partly upwardly in its extension into said housing.

* * * * *